US010501904B2

(12) United States Patent
Meixner

(10) Patent No.: US 10,501,904 B2
(45) Date of Patent: Dec. 10, 2019

(54) COMPACTING ROLL

(71) Applicant: Hamm AG, Tirschenreuth (DE)

(72) Inventor: Franz Meixner, Tirschenreuth (DE)

(73) Assignee: Hamm AG, Tirschenreuth (DE)

( * ) Notice: Subject to any disclaimer, the term of this patent is extended or adjusted under 35 U.S.C. 154(b) by 0 days.

(21) Appl. No.: 16/142,083

(22) Filed: Sep. 26, 2018

(65) Prior Publication Data

US 2019/0093299 A1 Mar. 28, 2019

(30) Foreign Application Priority Data

Sep. 27, 2017 (DE) ..... 10 2017 122 371

(51) Int. Cl.

| | |
|---|---|
| ***B06B 1/16*** | (2006.01) |
| ***E02D 3/02*** | (2006.01) |
| ***E01C 19/28*** | (2006.01) |
| ***E01C 19/48*** | (2006.01) |
| ***E02D 3/074*** | (2006.01) |
| ***E02D 3/026*** | (2006.01) |

(52) U.S. Cl.

CPC ..... *E02D 3/074* (2013.01); *B06B 1/16* (2013.01); *E01C 19/282* (2013.01); *E01C 19/286* (2013.01); *E02D 3/026* (2013.01); *E01C 19/488* (2013.01)

(58) Field of Classification Search

CPC ..... E01C 19/236; E01C 19/26; E01C 19/282; E01C 19/48; E01C 19/286; E02D 3/026

See application file for complete search history.

(56) References Cited

U.S. PATENT DOCUMENTS

| | | | | |
|---|---|---|---|---|
| 2,766,629 | A * | 10/1956 | Booth | B06B 1/166 209/326 |
| 9,222,226 | B2 * | 12/2015 | Villwock | E02D 3/026 |
| 9,650,747 | B2 * | 5/2017 | Villwock | E02D 3/039 |
| 2004/0005191 | A1 * | 1/2004 | Geier | E01C 19/286 404/117 |

(Continued)

FOREIGN PATENT DOCUMENTS

| | | |
|---|---|---|
| CN | 102605706 | 7/2012 |
| EP | 2504490 | 10/2012 |

(Continued)

OTHER PUBLICATIONS

German Search Report filed in Application No. 10 2017 122 371.1 dated Jul. 27, 2018.

*Primary Examiner* — Abigail A Risic

(74) *Attorney, Agent, or Firm* — Rankin, Hill & Clark LLP

(57) ABSTRACT

A compacting roll for a soil compactor includes a roll shell concentrically surrounding a roll rotational axis, a roll inner space and two oscillatory arrangements, at least partially arranged within the roll inner space, for generating the oscillating torque impinging on the roll shell with respect to the roll rotational axis, whereat each oscillatory arrangement includes at least two oscillation mass units that are rotatable around the respective oscillation rotational axis and at least one oscillation drive motor to serve exclusively for driving the oscillation mass units of this oscillatory arrangement. The oscillation mass units of different oscillatory arrangements can be offset from each other in the direction of the roll rotation axis.

9 Claims, 3 Drawing Sheets

(56) References Cited

U.S. PATENT DOCUMENTS

| | | | | |
|---|---|---|---|---|
| 2014/0305234 | A1* | 10/2014 | Kleibl | B06B 1/161 74/61 |
| 2015/0152606 | A1* | 6/2015 | Erdmann | E01C 19/283 404/117 |
| 2015/0211195 | A1* | 7/2015 | Fischer | E01C 19/286 404/103 |
| 2016/0024724 | A1* | 1/2016 | Schmidt | E01C 19/266 404/132 |

FOREIGN PATENT DOCUMENTS

| | | |
|---|---|---|
| EP | 2881516 | 6/2015 |
| FR | 2748500 | 11/1997 |

* cited by examiner

COMPACTING ROLL

The present invention relates to a compacting roll for a soil compactor with a roll shell concentrically surrounding a roll rotational axis and enclosing a roll inner space.

In order to achieve a better compression result in compacting ground, such as asphalt, soil or gravel, it is known to superimpose the weight of the compacting roll roll rolling on the ground that is to be compacted to its static load or alternatively by superimposing the dynamic conditions of the compacting roll supported by the ground. Thus, in order to generate a so-called vibration state, a compacting roll can periodically be accelerated and decelerated in a substantially vertical manner, namely in a direction that is fundamentally orthogonal to the surface of the ground that is to be compacted. In order to create a so-called oscillation state, an oscillating torque can be generated, which periodically impings a compacting roll back and forth around the roll rotational axis in circumferential direction.

A soil compactor with a compacting roll in which this type of oscillation state can be produced is known from EP 2 504 490 B1. This compacting roll, also generally referred to as oscillation roll, comprises an oscillatory arrangement with a total of four oscillation mass units in the inner space enclosed by a roll shell. These oscillation mass unites are assigned to each other in pairs, opposite each other with respect to the roll rotational axis, i.e. arranged at an angular distance of 180°. All oscillation mass units are driven by a common drive shaft and a common oscillation drive motor for rotation around the respective oscillation rotational axes. As a result of the common drive, each of the pairs of oscillation mass units arranged at an axial distance in the direction of the roll rotational axis generates an oscillating torque in phase, which periodically acts on the roll shell in the circumferential direction around the roll rotational axis.

EP 2 881 516 B1 discloses a soil compactor with a compacting roll comprising a roll inner space enclosed by a roll shell in which two imbalance mass units are arranged so as to be rotatable around the imbalance rotational axes that are arranged at a distance from the roll rotational axis. The two imbalance mass units or their shafts which can be driven for rotation are positioned next to one another, resulting in that the imbalance mass units or their centers of mass are not offset from one another in the direction of the roll rotational axis, i.e. lie in a common plane orthogonal to the roll rotational axis. Each of these imbalance mass units is assigned an imbalance drive motor exclusively driving this rotation around the respective imbalance axis. Through appropriate control of the imbalance drive motors, the juxtaposed imbalance mass units can be driven in such a way that they act together as an oscillation mass arrangement and generates an oscillating torque impinging the roll shell back and forth in the circumferential direction around the roll rotational axis.

The present invention's objective to provide a compacting roll for a soil compactor that provides an increased variability in the generation of an oscillating torque.

According to the invention, this objective is achieved by a compacting roll for a soil compactor, comprising a roll shell concentrically surrounding a roller rotational axis, a roll inner space and two oscillatory arrangements, at least partially arranged within the roll inner space, for generating the oscillating torque impinging on the roll shell with respect to the roll rotational axis, whereat each oscillatory arrangement comprises at least two oscillation mass units that are rotatable around the respective oscillation rotational axis and at least one oscillation drive motor to serve exclusively for driving the oscillation mass units of this oscillatory arrangement.

Unlike in the case of the roller-compressor disclosed in EP 2 881 516 B1, in which two separately driven imbalance mass units can work together to provide the oscillation effect of an oscillatory arrangement depending on the drive state, a compacting roll constructed according to the invention is provided with two oscillatory arrangements that are basically constructed separately from one another, can be operated independently of each other and can generate oscillating torques which are mutually adjustable in their speed and in their phase position. Thus, the torques provided by the various oscillatory arrangements can be constructively or destructively superimposed, whereby the total oscillating torque acting on the compacting roll or roll shell is correspondingly variable, both in terms of size as well as frequency, whereat the size of the oscillating torque and frequency of the oscillating torque can be adjusted independent of each other.

In this case, the oscillation mass units of various oscillatory arrangements can be offset in relation each other in the direction of the roll rotational axis, preferably in such a way that they do not overlap each other in the direction of the roll rotational axis.

For a compact construction, it is suggested that at least two oscillation mass units of an oscillation mass arrangement are not offset from one another in the direction of the roll rotational axis in at least one, yet preferably in each oscillatory arrangement. This means, in particular, that the centers of mass of these oscillation mass units are essentially not offset from one another in the direction of the roll rotational axis, that is, for example, lie in a common plane orthogonal to the roll rotational axis.

In order to ensure that torques acting in the circumferential direction with respect to the roll rotational axis are generated in the oscillatory arrangements, it is proposed that at least two oscillation mass units, paired with respect to the roll rotational axis, are arranged opposite each other, preferably with an angular distance of 180°, in at least one, yet preferably each oscillatory arrangement.

In order to provide a fundamentally symmetrical structure in the roll inner space and thus also to be able to support a defined interaction of the oscillatory arrangements, it is proposed that the oscillation mass units of different oscillatory mass arrangements are arranged with respect to each other in such a way, that at least one, preferably each oscillation mass unit of an oscillatory mass arrangement is provided with an oscillation mass unit of the other oscillatory mass arrangement coaxially arranged to it.

In order to be able to coordinate the effect of the oscillating arrangements in a defined manner during operation of a compacting roll constructed according to the invention, a rotational position sensor for providing information regarding the rotational position of the oscillating mass units of this oscillatory arrangement can be provided in allocation to each oscillatory arrangement. Further, a drive arrangement may be provided for driving the oscillation drive motors based on the information provided by the rotational position sensors.

In particular, when a single oscillation drive motor is provided for each oscillatory arrangement to drive its oscillation mass units for rotation, it is suggested to ensure drive coupling by providing at least one, preferably each oscillatory arrangement with a belt drive for driving the oscillation mass units of this oscillatory arrangement for rotation around their oscillation rotational axes.

In a particularly preferred embodiment, it is proposed that one of the oscillatory arrangements is essentially arranged in a length-halved area of the roll inner space and the other oscillatory arrangement is arranged in the other length-halved area of the roll inner space. Thus, each of the oscillatory arrangements generates the oscillating torque to be provided by it in the respective length-halved area of the roll inner space, i.e. in different axial areas of the compacting roll. Since the roll shell being impinged upon by the oscillating torques generated in this manner is very stiff in itself, the application of torques which are, for example, out of phase in different axial regions of the roll shell does not impair the functionality or the operating characteristics of the roll shell or the compacting roll.

In order to avoid mutual interference, it is proposed that the oscillatory arrangements do not overlap one another in the direction of the roll rotational axis.

The invention further relates to a soil compactor comprising at least one compacting roll featuring a structure as described above.

Hereinafter, the present invention will be described in detail with reference to the annexed figures. Shown in:

Figure 1:
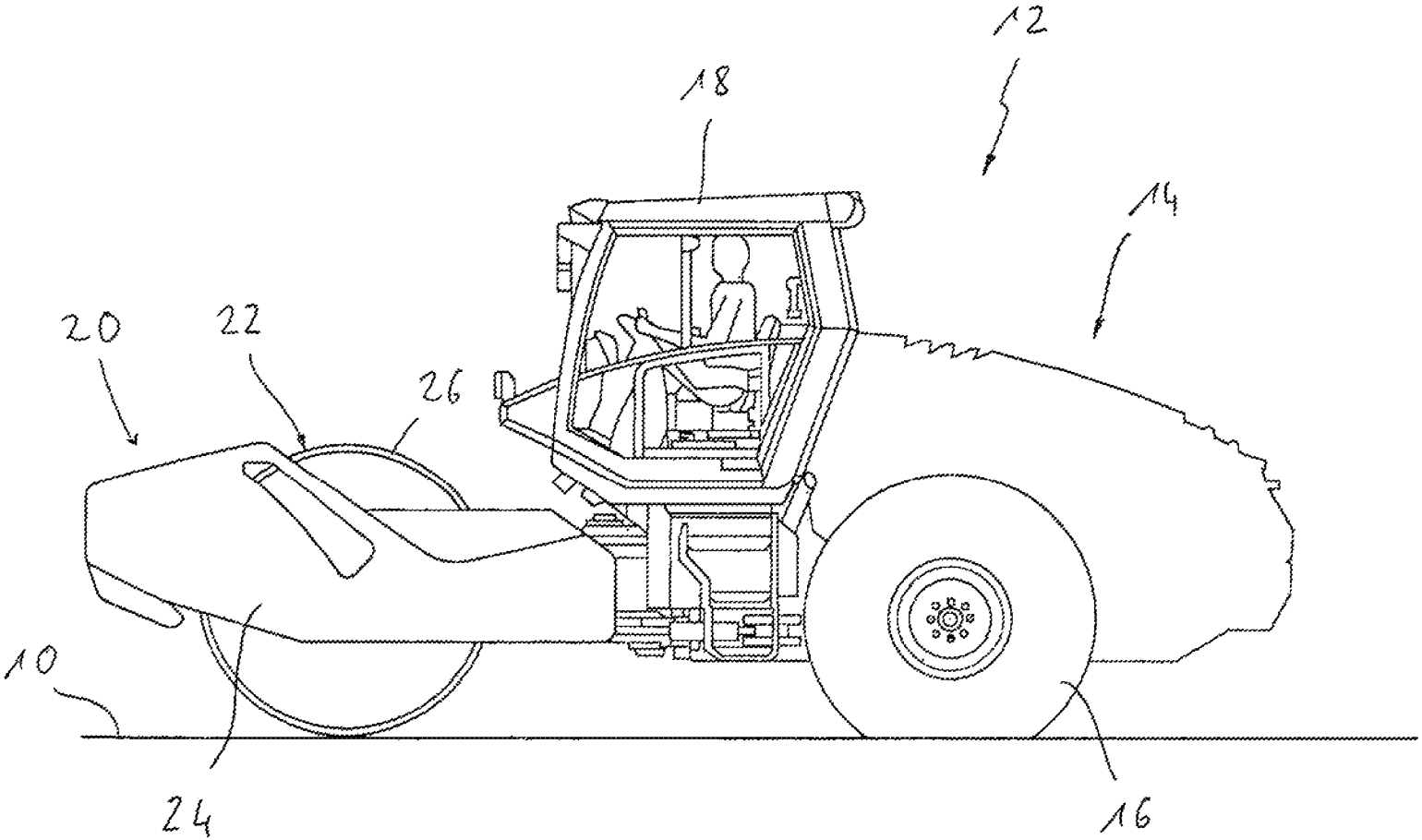
FIG. 1 is a soil compactor in side view.
Figure 2:
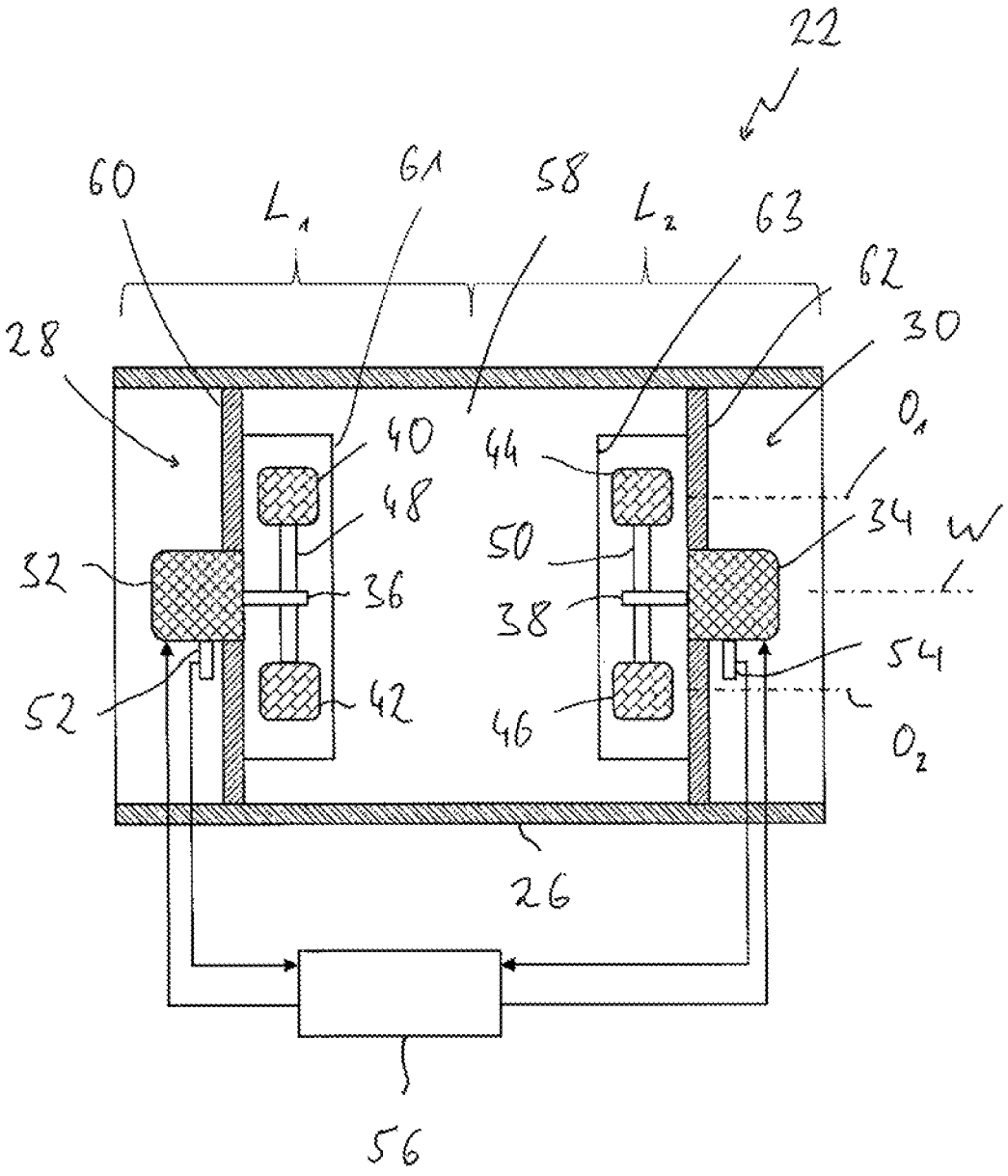
FIG. 2 is a longitudinal sectional view of a soil compactor's compacting roll constructed according to the invention, in a schematic representation.
Figure 3:
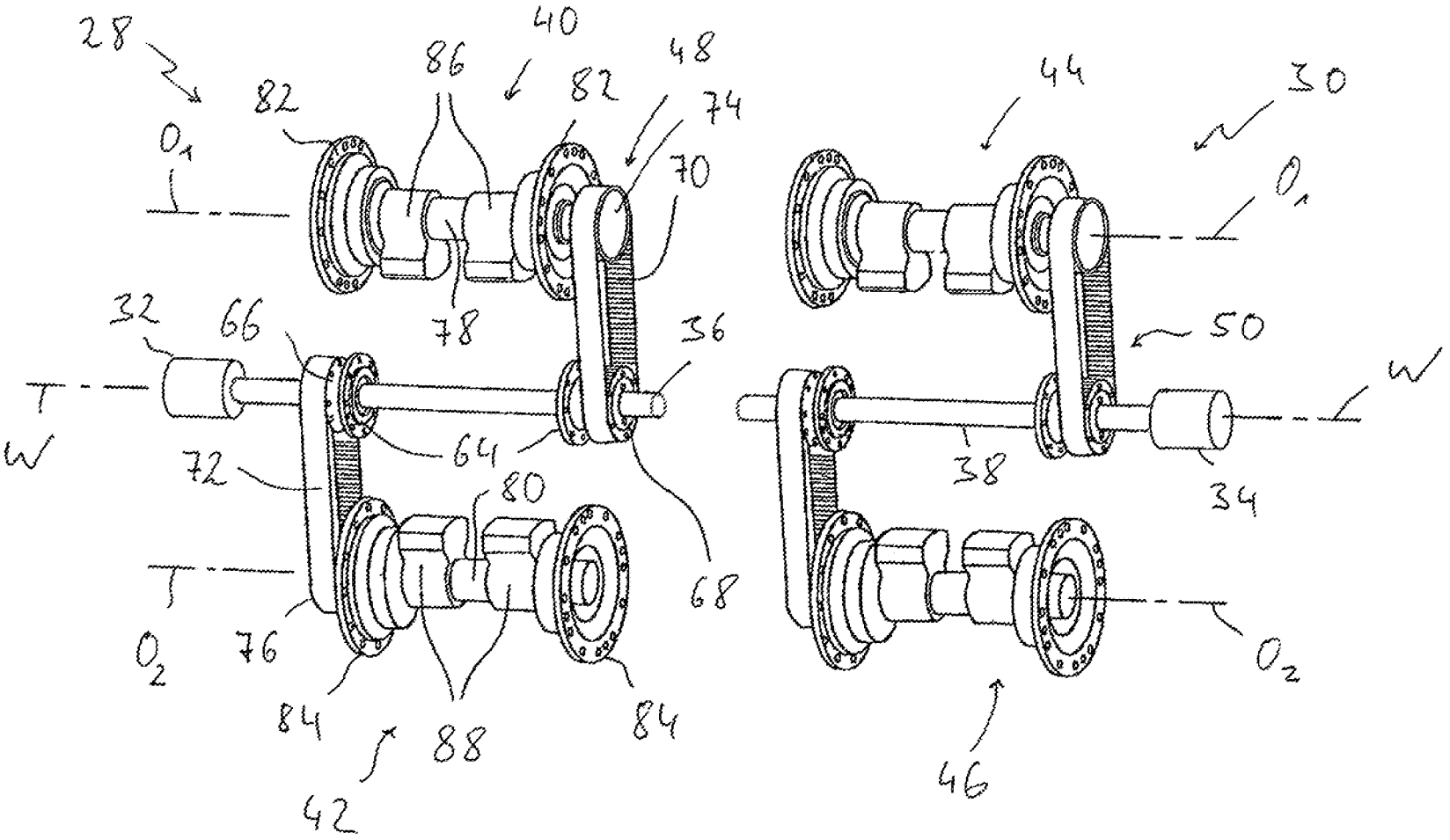

FIG. 3 are two oscillating arrangements of the compacting roll of FIG. 2 in perspective view In FIG. 1, a soil compactor to be used for compacting a ground 10 is generally designated 12. The soil compactor 12 comprises a drive assembly and the wheels driven thereby 16 at a rear vehicle 14. Further, an operator station 18 is provided at the rear carriage 14 for the operator operating the soil compactor 10.

At a front vehicle 20 that can be pivoted around an essentially vertical axis in relation to the rear vehicle 14, a compacting roll, generally designated 22, is supported on a compacting roll frame 24 in a manner that allows for rotation around a roll rotation axis standing orthogonal to the plane of the drawing of FIG. 1.

In the exemplary embodiment illustrated in FIG. 1, the soil compactor 12 is driven by the drive wheels 16 for movement over the ground 10, during which movement the compacting roll 22 rolls on the ground 10 with a roll shell 26 concentrically surrounding the roll rotation axis, thereby compressing ground 10 by means of the static load transmitted by the compacting roll 22. In order to allow for increasing the degree of compaction or to achieve a better compaction result, the compacting roll is impinged with an oscillating torque, i.e. a torque being periodically accelerated and decelerated in the circumferential direction around the roll rotation axis, as described below with reference to FIGS. 2 and 3.

Before the generation of such an oscillating torque is explained in the following with reference to FIGS. 2 and 3, it should be noted that, of course, the soil compactor 12 can also be embodied in other ways. Thus, for example, a compacting roll could also be provided on the rear carriage 14, which could be constructed with regard to the generation of an oscillating torque, for example, as described below with reference to FIGS. 2 and 3. That means, both compacting rolls provided on a soil compactor could be constructed in such a way that they can be impinged by an oscillating torque, in which case additionally at least one of the compacting rolls can be impinged with a drive torque by one or more drive motors for driving the soil compactor. Also, the soil compactor could be a smaller, hand-operated device in which an operator does not position himself in control station, but, as an example, is rather located in front of or behind the soil compactor during the compression process.

FIG. 2 shows, in a basic representation and in longitudinal section, a compacting roll 22 with its roll shell 26 concentrically arranged relative to the roll rotational axis W. The roll shell 26 or the compacting roll 22 can basically be viewed as divided into two length halves $L_1$ and $L_2$, whereat it must be emphasized that these two length-halved areas $L_1$, $L_2$ are structurally not separated from each other, i.e. length-halved areas form one and the same compacting roll 22 and one and the same roll shell 26. The compacting roll 22 constructed according to the invention and its roll shell 26 thus extend in the direction of the roll rotational axis D without interruption, unlike is the case in a divided compacting roll, which comprises two immediately adjacent, structurally separate compacting roll areas, for example, each provided with an independent rotation drive.

Each of the two length-halved areas $L_1$, $L_2$ are provided with an oscillatory arrangement 28, 30. The two oscillatory arrangements 28, 30 may be essentially identical to one another in terms of their design and comprise an oscillation drive motor 32, 34 concentric with the roll rotation axis W, in each case with a drive shaft 36, 38 preferably concentric with the roll rotation axis W. For example, the two oscillation drive motors 32, 34 may be in the form of hydraulic motors.

Each oscillatory arrangement 28, 30 further comprises two oscillation mass units 40, 42 and 44, 46 arranged eccentrically with respect to the roll rotational axis. Each oscillation mass unit 40, 42, 44, 46 comprises, as described in more detail below with reference to FIG. 3, at least one imbalance mass rotatable around the oscillation rotational axis $O_1$ or $O_2$. In this case, the oscillation mass units 40, 42, 44, 46 are arranged in such a manner that each of the oscillationan mass units 40, 42 and 44, 46 provided in oscillatory arrangements 28, 30 arranged in pairs are opposite of each other with respect to the roll axis of rotation W, i.e. have an angular distance of 180° to each other. For each of the oscillation mass units 40, 42 and 44, 46 of the oscillatory arrangements 28, 30, an oscillation mass unit of the respective other oscillatory arrangement is arranged in such a manner that these can rotate around a common axis of oscillation oscillation $O_1$ or $O_2$. For example, the oscillation mass units 40, 44 of the oscillatory arrangements 28, 30 rotate around the common oscillation rotational axis $O_1$, while the oscillation mass units 42, 46 of the two oscillatory arrangements 28, 30 rotate around the common oscillation axis $O_2$.

To drive the respective oscillation mass units 40, 42 and 44, 46, each of the oscillatory arrangements 28, 30 comprise a belt drive generally designated 48 and 50. Each belt drive can comprise one or more drive belts, for example toothed belts, which cooperate with the respective drive shaft 36, 38 or the oscillation mass units 40, 42, 44, 46 via respective pulleys.

At least one rotational position sensor 52, 54 is provided in relation with each oscillatory arrangement 28, 30. This can for example be provided on the respective oscillation drive motor 32 and 34 and detect the rotational position of a rotor, for example, the respective drive shaft 36, 38, whereby it also provides information regarding the rotational position of the respective imbalance mass units 40, 42 and 44, 46 and the respective imbalance masses provided thereto. This rotational position information is fed into a control arrangement, generally designated with 56. The control arrangement 56 can, under consideration of this rotational position information, control the oscillation drive motors 32, 34 of the two oscillatory arrangements 28, 30 in order to operate them at a specific rotational speed and a specific phase position relative to one another. This allows for each of the oscillatory arrangements 28, 30 to generate an oscillation torque that accelerates or impinges the compacting roll 22 or the roll shell 26 in circumferential direction around the roll rotational axis W. Depending on the phase position of the oscillating torques generated by the two oscillatory arrangements 28, 30, these can be superimposed in a constructive or destructive manner, so as to, for example, exert a total oscillating torque on the roll shell 22 at maximum constructive superimposition of the two oscillating torques generated by the oscillatory arrangements 28, 30, which corresponds to the sum of the two oscillating torques, i.e., for example, twice the oscillating torque generated by a single one of the respective oscillatory arrangements 28, 30, provided the oscillating torques generated by the two oscillatory arrangements 28, 30 are fundamentally equal. At maximum destructive superimposition, the resulting total oscillating torque is in the range of zero. By adjusting or changing the phase position of the oscillating torques of the two oscillatory arrangements 28, 30 with respect to each other, the achievable total oscillating torque can consequently be adjusted within this spectrum.

FIG. 2 shows that the two oscillatory arrangements 28, 30 are each arranged in one of the two length-halved areas $L_1$, $L_2$ and do not substantially act in the respective other length-halved area or overlap in the direction of the roll rotational axis W. This means that a clear physical division of the two oscillatory arrangements 28, 30 is intended, so that a reciprocal obstruction is avoided during operation as well as installation in the roll shell 26 enclosed by the roll inner space 58. For example, each of the two oscillatory arrangements 28, 30 may be supported on a preferably disc-like carrier 60, 62, also commonly referred to as a round plate, provided in the roll inner space 58 and also connected to the roll shell 26. Of course, to ensure stable support, in particular the oscillation mass units 40, 42 and 44, 46 may also be supported on several or in between two such carriers 60, 61 and 62, 63, in order to thereby transfer the imbalance torque generated by them to the carriers 60, 61, 62, 63 and the roll shell 26.

It should be noted that, depending on the size of the oscillatory arrangement 28, 30 and the compacting roll 22, for example, the oscillation drive motors 32, 34 may axially protrude beyond the roll inner space 58 or the roll shell 26 in the direction of the roll rotational axis, in particular with areas in which these are to be connected to a hydraulic system of a soil compactor. For the purposes of the present invention, however, this does not exclude that such an oscillatory arrangement would fundamentally be arranged in a respectively allocated length-halved region of the roll inner space or the compacting roll.

FIG. 3 shows an example of a structural design of two oscillatory arrangements 28, 30. These are substantially identical to one another, as already explained above with reference to FIG. 2, but could in principle be built with mirror symmetry in relation to a symmetry plane that is substantially orthogonal to the roll rotational axis W.

Since the two oscillatory arrangements 28, 30 are fundamentally identical to one another, their structure will be explained in detail below referencing only the oscillatory arrangement 28.

The drive shaft 38 of the oscillation drive motor 52 can be supported in a rotatable manner by two bearing discs 64 capable of accommodating them in a rotatable manner, which are provided on carriers in the roll inner space, as previously explained with reference to FIG. 2. Drive shaft 38 supports pulleys 66, 68, which are in drive engagement with belts 70, 72 of the belt drive 48. These belts 70, 72 are further in drive engagement with pulleys 74, 76 on the respective imbalance shafts 78, 80 of the two oscillation mass units 40, 42 of the oscillatory arrangement 28. These imbalance shafts 78, 80 can also be supported in a rotatable manner on the previously discussed carriers in the roll inner space by these bearing discs 82, 84, generally allowing them to rotate around the oscillation rotational axes $O_1$ or $O_2$ parallel to rotational axis W.

In drive state, the drive torque generated by the oscillation drive motor 32 is transferred to the imbalance shafts 78, 80 of the two oscillation mass units 40, 42 via the drive shaft 38 and the two belts 70, 72, so that the imbalance shafts 78, 80 rotate around the oscillation rotational axes $O_1$, $O_2$.

Each of the two oscillation mass units 40, 42 comprises two axially spaced-apart imbalance masses 86, 88 at the respective imbalance shaft 78, 80. Their center of mass lies eccentrically to the respective oscillation rotational axis $O_1$ or $O_2$, whereat, for example, the imbalance masses 86, 88 provided in each of the imbalance mass units 40, 42 may be arranged in such a manner that their center of mass lies in the same circumferential range with respect to the respective oscillation rotational axis $O_1$ or $O_2$. Thus, for each oscillation mass unit 40, 42, an overall center of mass of the two imbalance masses 86, 88 results that approximately lies centrally between the two imbalance masses 86, 88 of the respective oscillation mass unit 40, 42 in the direction of the respective oscillation rotational axis $O_1$, $O_2$. In this case, the arrangement is preferably such that the two total centers of mass of the two imbalance mass units 40, 42 lie in a plane that is orthogonal to the roll rotational axis W. It should be noted that naturally, in each case, a different number of imbalance masses could be provided for the imbalance mass units 40, 42. Thus, for example, a single imbalance mass could be provided, whereat its center of mass then essentially also defines the axial position of the center of mass of a respective imbalance mass unit.

In FIG. 3 it can further be seen that the imbalance masses 86, 88 of the two imbalance mass units 40, 42 are arranged in such a manner that they are phase-shifted by 180° to each other. In rotational operation, the imbalance torques of the two oscillation mass units 40, 42 are superimposed in such a manner that an oscillating torque is generated, i.e. a torque that periodically accelerates the carriers supporting the imbalance mass units 40, 42 and thus also the assemblies coupled with it, in particular roll shell 26, in the circumferential direction back and forth around the roll rotational axis W. Since, as already stated above, the two oscillatory arrangements 28, 30 are operable independently of each other, and thus adjustable with respect to each other, in particular also with respect to the phase angle of each oscillatory torque that can be generated, the total oscillating torque thus generated can be adjusted within a large variation spectrum by means of the previously described superposition of the oscillating torques, whereat the speed of the imbalance masses also represents a variable parameter.

It should be noted that, without departing from the principles of the present invention, the compacting roll described above may be varied in a number of ways. Thus, given a respective size of the compacting roll, more than two oscillatory arrangements that can be operated independently of one another and, for example, in the direction of the roll rotational axis could be provided. Each oscillatory arrangement could also feature more than two oscillation units, for example four oscillation units, in which case two oscillation units are arranged in pairs opposite one another with an angular offset of 180° with respect to the roll rotational axis. Such pairs of oscillation units of an oscillatory arrangement can be arranged in the same axial region, i.e. positioned next to each other, but could also be axially offset from one another or arranged axially one after the other. Furthermore, the oscillatory arrangements could be provided with a plurality of oscillation drive motors, in particular if these feature more than two oscillation units, so that, for example, in each oscillatory arrangement, each oscillation unit or at least each pair of oscillation units has an oscillation drive motor exclusively driving it. Here, too, the arrangement according to the invention is maintained, in which different oscillatory arrangements are fundamentally structurally and functionally separate from one another, that is to say they can be driven independently, yet of course in coordination with one another. A respective oscillation drive motor can in principle also be designed as an electric motor. Furthermore, the oscillation mass arrangements can also be driven for rotation by other gear arrangements, such as a cogwheel drive, by means of a respective associated oscillation drive motor.

In a further embodiment of the present invention, the oscillation mass units of different oscillatory arrangements could be juxtaposed, thus axially overlapping one another so that, for example, one pair of oscillation mass units of one of the oscillatory arrangements that are facing each other with respect to the roll rotational axis would have an angular distance of for example 90° in relation to another pair of oscillation mass units of another oscillatory arrangement that are facing each other with respect to the roll rotational axis. The oscillation mass units allocated to the various oscillatory arrangements are in turn to be driven for rotation exclusively by these separate oscillation drive motors used for driving rotation, so that each of the oscillatory arrangement can generate the oscillating torque to be provided by it independently of the respective other oscillatory arrangement.

The invention claimed is:

1. A compacting roll for a soil compactor, comprising a roll shell concentrically surrounding a roll rotational axis, a roll inner space and two oscillatory arrangements, at least partially arranged within the roll inner space, for generating an oscillating torque impinging on the roll shell with respect to the roll rotational axis, whereat each oscillatory arrangement comprises at least two oscillation mass units that are rotatable around the respective oscillation rotational axis and at least one oscillation drive motor to serve exclusively for driving the oscillation mass units of this oscillatory arrangement, whereat the oscillation mass units of different oscillatory arrangements are offset from one another in direction of the roll rotational axis and do not overlap one another in the direction of the roller rotation axis, and wherein each oscillatory arrangement features at least two oscillation mass units that are arranged in pairs opposite one another with respect to the roller rotation axis.

2. The compacting roll according to claim 1, wherein at least one oscillatory arrangement features at least two oscillation mass units of an oscillatory arrangement that are not offset from one another in the direction of the roll rotation axis.

3. The compacting roll according to claim 1, wherein each oscillatory arrangement features at least two oscillation mass units that are arranged in pairs opposite one another with respect to the roller rotation axis, with an angular distance of 180°.

4. The compacting roll according to claim 1, wherein the oscillation mass units of different oscillatory mass arrangements are arranged with respect to each other in such a way, that at least one each oscillation mass unit of an oscillatory mass arrangement is provided with an oscillation mass unit of the other oscillatory mass arrangement coaxially arranged to it.

5. The compacting roll according to claim 1, wherein a rotational position sensor is provided in association with each oscillatory arrangement for providing information regarding the rotational position of the oscillation mass units of this oscillatory arrangement, and in that a control arrangement is provided for controlling the oscillation drive motors based on the information provided by the rotational position sensors.

6. The compacting roll according to claim 1, wherein at least one oscillatory arrangement is provided with a belt drive for driving the oscillation mass units of said oscillatory arrangement for rotation around their oscillation rotational axes.

7. The compacting roll according to claim 1, wherein one of the oscillatory arrangements is arranged in a length-halved area of the roll inner space and the other oscillatory arrangement is arranged in the other length-halved area of the roll inner space.

8. The compacting roll according to claim 1, wherein the oscillating arrangements do not overlap one another in the direction of the roll rotational axis.

9. A soil compactor comprising at least one compacting roll according to claim 1.

* * * * *